US006503290B1

(12) United States Patent
Jarosinski et al.

(10) Patent No.: US 6,503,290 B1
(45) Date of Patent: Jan. 7, 2003

(54) CORROSION RESISTANT POWDER AND COATING

(75) Inventors: William John Crim Jarosinski, Carmel, IN (US); Lewis Benton Temples, Pittsburgh, PA (US)

(73) Assignee: Praxair S.T. Technology, Inc., North Haven, CT (US)

( * ) Notice: Subject to any disclaimer, the term of this patent is extended or adjusted under 35 U.S.C. 154(b) by 0 days.

(21) Appl. No.: 10/087,093

(22) Filed: Mar. 1, 2002

(51) Int. Cl.[7] ..... B22F 1/00; C23C 30/00
(52) U.S. Cl. ..... 75/252; 427/455
(58) Field of Search ..... 75/252; 427/455

(56) References Cited

U.S. PATENT DOCUMENTS

| | | | | |
|---|---|---|---|---|
| 2,124,020 A | | 7/1938 | Wirth | 75/136 |
| 3,846,084 A | | 11/1974 | Pelton | 29/191.2 |
| 4,123,266 A | * | 10/1978 | Foley et al. | 419/10 |
| 4,224,382 A | | 9/1980 | Brown et al. | 428/656 |
| 4,231,793 A | | 11/1980 | Kruske et al. | 75/122 |
| 4,353,742 A | | 10/1982 | Crook | 75/122 |
| 4,519,840 A | | 5/1985 | Jackson et al. | 106/1.05 |
| 4,626,476 A | * | 12/1986 | Londry et al. | 428/457 |
| 4,731,253 A | | 3/1988 | DuBois | 427/34 |
| 4,999,255 A | | 3/1991 | Jackson et al. | 428/552 |
| 5,030,519 A | | 7/1991 | Scruggs et al. | 428/614 |
| 5,102,452 A | | 4/1992 | Taskinen et al. | 75/342 |
| 5,141,571 A | | 8/1992 | DuBois | 148/427 |
| 5,387,294 A | * | 2/1995 | DuBois | 148/427 |
| 5,419,976 A | * | 5/1995 | Dulin | 428/570 |
| 5,514,328 A | | 5/1996 | Menon et al. | 420/36 |
| 5,611,306 A | | 3/1997 | Takano | 123/188.3 |
| 5,863,618 A | | 1/1999 | Jarosinski et al. | 427/450 |
| 6,004,372 A | | 12/1999 | Quets | 75/255 |

OTHER PUBLICATIONS

Cabot Corporation brochure entitled "Stellite Surfacing Alloy Powders" (1982).

* cited by examiner

*Primary Examiner*—Ngoclan Mai
(74) *Attorney, Agent, or Firm*—Cornelius F. O'Brien

(57) ABSTRACT

The invention is a corrosion resistant powder useful for deposition through thermal spray devices. The powder consists essentially of, by weight percent, 30 to 60 tungsten, 27 to 60 chromium, 1.5 to 6 carbon, a total of 10 to 40 cobalt plus nickel and incidental impurities plus melting point suppressants.

20 Claims, 2 Drawing Sheets

CORROSION RESISTANT POWDER AND COATING

FIELD OF THE INVENTION

This invention relates to a chromium-tungsten or tungsten-chromium alloy powder for forming coatings or objects having an excellent combination of corrosion and wear properties.

BACKGROUND ART

Hard surface coating metals and alloys have long been known. For example, chromium metal has been used as an electroplated coating for many years to restore worn or damaged parts to their original dimensions, to increase wear and corrosion resistance, and to reduce friction. Hard chromium electroplate, however, has a number of limitations. When the configuration of the part becomes complex, obtaining a uniform coating thickness by electro-deposition is difficult. A non-uniform coating thickness necessitates grinding to a finished surface configuration, which is both difficult and expensive with electroplated chromium. These disadvantages arise from chromium's inherent brittleness and hardness. Furthermore, chromium electroplating has a relatively low deposition rate and often requires a substantial capital investment in plating equipment. In addition to this, it is often necessary to apply one or more undercoats, or to use expensive surface cleaning and etching procedures to prepare substrates for chromium deposition. Disposal of spent plating baths also adds significantly to the cost of the process.

An alternative method of depositing chromium metal is by metal spraying such as with a plasma or detonation gun. This method allows the coating to be applied to almost any metallic substrate without using undercoats. The rate of deposition is very high, minimizing the capital investment. Furthermore, the coating thickness can be controlled very closely so that any subsequent finishing can be kept to a minimum. And finally, the overspray can be easily contained and recovered making pollution control a simple matter.

Unfortunately, plasma-deposited chromium is not as wear-resistant at ambient temperature as hard electroplated chromium. This is because the wear-resistant of chromium plate is not an inherent property of elemental chromium but is believed to arise largely from impurities and stresses incorporated in the coating during plating. Plasma deposited chromium is a purer form of chromium that lacks the wear-resistant of hard chromium plate; but it retains the corrosion-resistance characteristics of electroplated hard chromium.

Improved coatings can be made by incorporating a dispersion of chromium carbide particles in a chromium matrix for wear resistance. Coatings of this type can be made from mechanical mixtures of powders. However, there are certain limitations to the quality of coatings made from them. Both plasma and detonation-gun deposition result in a coating with a multilayer structure of overlapping, thin, lamella or "splats." Each splat is derived from a single particle of the powder used to produce the coating. There is little, if any, combining or alloying of two or more powder particles during the coating deposition process. This results in some of the splats being completely chromium alloy and some being completely chromium carbide, with the interparticle spacing being controlled by the sizes of the initial chromium and chromium carbide powder particles. J. F. Pelton, in U.S. Pat. No. 3,846,084 describes a powder in which substantially every particle consists of a mixture of chromium and chromium carbides. The powder of this patent produces a coating wherein each splat is a mixture of chromium and chromium carbides.

Hard surface coatings can also be made using sintered cobalt structures that encapsulate tungsten carbide particles. These alloys however have undesirably high porosity for some applications and are limited in their tungsten carbide content.

Alloys containing carbides of tungsten, chromium, and nickel have been used in hard surfacing. For example, Kruske et al., in U.S. Pat. No. 4,231,793, disclose an alloy containing from 2 to 15 weight percent tungsten, 25 to 55 weight percent chromium, 0.5 to 5 weight percent carbon, and amounts of iron, boron, silicon, and phosphorus that do not exceed 5 weight percent each, with the balance being nickel. Similarly, S.C. DuBois, in U.S. Pat. No. 4,731,253 disclose an alloy containing from 3 to 14 weight percent tungsten, 22 to 36 weight percent chromium, 0.5 to 1.7 weight percent carbon, 0.5 to 2 weight percent boron, 1.0 to 2.8 weight percent and a balance of nickel.

S. C. DuBois describes another hard surfacing alloy containing tungsten and chromium in U.S. Pat. No. 5,141,571. The tungsten content of this alloy is from 12 to 20 weight percent, the chromium content is from 13 to 30 weight percent, and the carbon content is from 0.5 to 1 weight percent. The alloy also contains from 2 to 5 percent each of iron, boron, and silicon, with the balance being nickel. This hard facing alloy contains embedded tungsten carbide and chromium carbide crystals.

Cabot Corporation (Now Haynes Intl.) published a group of corrosion resistant alloys referred to as the "Stellite Alloys" in its 1982 brochure entitled *"Stellite Surfacing Alloy Powders"*(Stellite is a registered trademark of Deloro Stellite Inc.). The Stellite alloy compositions disclosed in this reference contain from 0 to 15 percent tungsten, from 19 to 30 weight percent chromium, from 0.1 to 2.5 weight percent carbon, up to 22 weight percent nickel, and amounts of iron, boron and silicon that do not exceed 3 weight percent each, with the balance being cobalt.

SUMMARY OF THE INVENTION

The invention is a corrosion resistant powder useful for deposition through thermal spray devices. The powder consists essentially of, by weight percent, about 30 to 60 tungsten, about 27 to 60 chromium, about 1.5 to 6 carbon, a total of about 10 to 40 cobalt plus nickel and incidental impurities plus melting point suppressants. This corrosion resistant powder is useful for forming coatings having the same composition.

DETAILED DESCRIPTION

Figure 1:
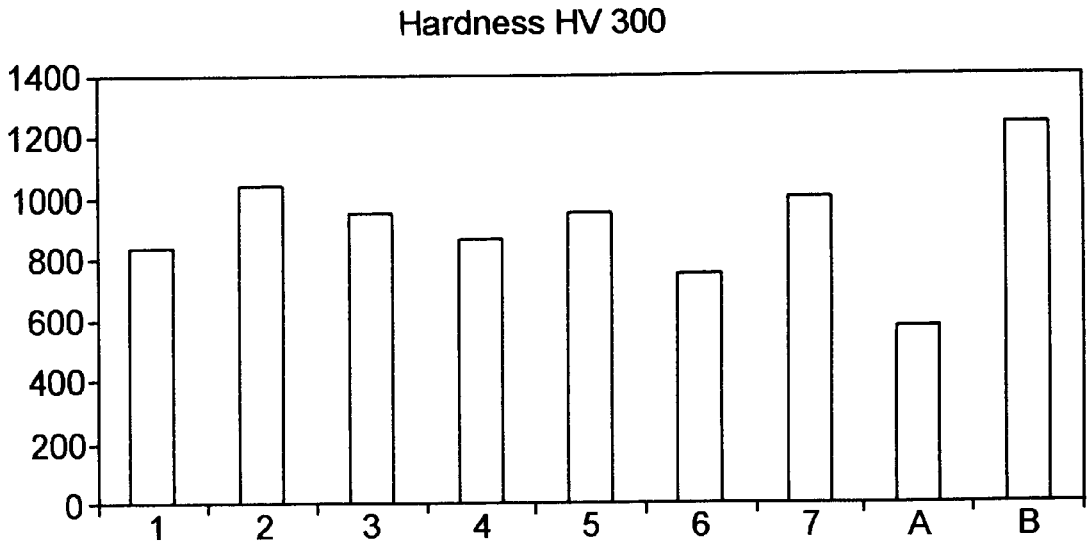
FIG. 1 is a bar graph of Vicker's Hardness HV300 that compares coatings of the invention to earlier corrosion resistant coatings.

The alloy relies upon a large concentration of chromium and tungsten for excellent corrosion and wear resistance. Advantageously, the alloy contains at least about 27 weight percent chromium. Unless specifically referenced otherwise, this specification refers to all compositions by weight percent. Powders containing less than 27 weight percent chromium have inadequate corrosion resistance for many applications. Generally, increasing chromium increases corrosion resistance. But chromium levels in excess of about 60 weight percent tend to detract from the coating's wear resistance because the coating becomes too brittle.

Similarly, tungsten in amounts of at least about 30 weight percent increases hardness and contributes to wear resistance and can enhance corrosion resistance in several environments. But if the tungsten concentration exceeds 60 weight percent, the powder can form coatings having inadequate corrosion resistance.

The carbon concentration controls the hardness and wear properties of coatings formed with the powder. A minimum of about 1.5 weight percent carbon is necessary to impart adequate hardness into the coating. If the carbon exceeds 6 weight percent carbon however, then the powder's melting temperature becomes too high; and it becomes too difficult to atomize the powder. In view of this, it is most advantageous to limit carbon to 5 weight percent.

The matrix contains a minimum total of at least about 10 weight percent cobalt and nickel. This facilitates the melting of the chromium/tungsten/carbon combination that, if left alone, would form carbides having too high of melting temperatures for atomization. Increasing the concentration of cobalt and nickel also tends to increase the deposition efficiency for thermal spraying the powder. Because, total cobalt plus nickel levels above this concentration tend to soften the coating and limit the coating's wear resistance however, the total concentration of cobalt and nickel however is best maintained below about 40 weight percent. In addition the alloy may contain only nickel or cobalt, since coatings with only nickel (i.e. about 10 to 30 percent nickel) or only cobalt (i.e. about 10 to 30 percent cobalt) can form powders with corrosion resistance tailored for a specific application. But for most applications, cobalt and nickel are interchangeable.

Interestingly, this combination of chromium and tungsten (strong carbide formers) and about 1.5 to 6 weight percent carbon do not typically form carbides of a size detectable with a scanning electron microscope. The corrosion resistant powder typically has a morphology that lacks carbides having an average cross sectional width in excess of 10 $\mu$m. Advantageously, the corrosion resistant powder lacks carbides having an average cross sectional width in excess of 5 $\mu$m and most advantageously less than 2 $\mu$m. This powder's unexpected maintaining of a significant portion of its chromium in the matrix, rather than in large carbide precipitates, appears to further contribute to the coating's corrosion resistance. But despite the lack of carbides detectable by an optical microscope, the powders have excellent wear resistance.

Advantageously, the powders of this invention are produced by means of inert gas atomization of a mixture of elements in the proportions stated herein. The alloy of these powders are typically melted at a temperature of about 1600° C. and then atomized in a protective atmosphere. Most advantageously this atmosphere is argon. To facilitate melting for atomization, the alloy may optionally contain melting point suppressants like boron, silicon and manganese Excessive melting point suppressants however tend to decrease both corrosion and wear properties.

Alternatively, sintering and crushing, sintering and spray drying, sintering and plasma densification are possible methods for manufacturing the powder. Gas atomization however represents the most effective method for manufacturing the powder. Gas atomization techniques typically produce a powder having a size distribution of about 1 to 100 microns.

The following Table represents "about" the broad, intermediate and narrow composition of the powder and coatings formed from the powder.

TABLE 1

| Element | Broad | Intermediate | Narrow |
|---|---|---|---|
| Tungsten | 30–60 | 30–55 | 30–50 |
| Chromium | 27–60 | 27–55 | 30–50 |
| Carbon | 1.5–6 | 1.5–6 | 1.5–5 |
| Total Melting Point Suppressants | | 0–5 | 0–3 |
| Total Cobalt & Nickel* | 10–40** | 10–35 | 10–30 |

*Plus incidental impurities
**Plus Melting Point Suppressants

Table 2 contains the compositional ranges of three particular chemistries that form coatings having excellent corrosion and wear properties.

TABLE 2

| Element | Range 1 | Range 2 | Range 3 |
|---|---|---|---|
| Tungsten | 35–45 | 30–40 | 30–40 |
| Chromium | 30–40 | 40–50 | 45–50 |
| Carbon | 3–5 | 1.5–5 | 3–5 |
| Total Cobalt & Nickel | 15–25 | 15–25 | 10–15 |

These coatings may be produced using the alloy of this invention by a variety of methods well known in the art. These methods include the following: thermal spray, plasma, HVOF (high velocity oxygen fuel), detonation gun, etc.; laser cladding; and plasma transferred arc (PTA).

EXAMPLE

The following example represents an illustration of certain preferred embodiments of the invention and implies no limitation. The powders of Table 3 were prepared by atomizing in argon at a temperature of 1500° C. These powders were further segregated into a size distribution of 10 to 50 microns.

TABLE 3

| | Composition (weight %) | | | | |
|---|---|---|---|---|---|
| Powder | Cr | W | Co | Ni | C |
| 1 | 40 | 43 | 13 | 0.5 | 4.0 |
| 2 | 36 | 40 | 20 | 0 | 3.9 |
| 3 | 48 | 36 | 12 | 0 | 4.0 |
| 4 | 48 | 31 | 17 | 0 | 3.9 |
| 5 | 27 | 47 | 22 | 0 | 4.5 |
| 6 | 45 | 34 | 0.5 | 19 | 1.9 |
| 7 | 45 | 34 | 0 | 18 | 3.6 |
| A | 28 | 4.5 | 61 | 2.5 | 1.3 |
| B | 3.8 | 81 | 10 | 0 | 5.2 |

Note: Powders A and B represent comparative

Note: Powders A and B represent comparative examples. Powder A represents the Stellite® 6 composition and Powder B represents a WC wear-resistant powder.

The powders of Table 3 were then sprayed with a JP-5000® HVOF system on a steel substrate under the following conditions: oxygen flow 1900 scfh (53.8 $m^3$/h), kerosene flow 5.7 gph (21.6 1/h), carrier gas flow 22 scfh (0.62 $m^3$/h), powder feed 80 g/min., spray distance 15 in. (38.1 cm), torch barrel length 8 in. (20.3 cm) to form the coatings of Table 4.

TABLE 4

| Powder | HV 300 | Deposition Efficiency (%) |
|---|---|---|
| 1 | 840 | 46 |
| 2 | 1040 | 58 |
| 3 | 950 | 55 |
| 4 | 860 | 60 |
| 5 | 950 | 51 |
| 6 | 750 | — |
| 7 | 1000 | 51 |
| A | 600 | 66 |
| B | 1240 | 40 |

The date off Table 4 illustrate that the deposition efficiency compares favorable to a typical WC powder of Powder B. Furthermore, the bar graph of FIG. 1 shows excellent hardness achieved with powders of the invention.

Measuring wear resistance by multiple tests represented different potential wear applications. These testing methods included the following: test method ASTM G-65 (dry sand/rubber wheel); and test method ASTM G-76 (30 & 90 degree erosion using fine alumina). For the average friction test, measuring a ball (steel) on disk test with a 10N load determined the coefficient of friction. Table 5 below contains the data generated by these test methods.

TABLE 5

| Powder | Sand vol. Loss ($mm^3$/1000 rev.) | Erosion 30 deg. ($\mu$m/g) | Erosion 90 deg. ($\mu$m/g) | Friction avg. |
|---|---|---|---|---|
| 1 | 4.0 | 21 | 121 | — |
| 2 | 5.5 | 30.3 | 107 | 0.62 |
| 3 | 3.0 | 22 | 115 | — |
| 4 | 5.4 | 26.9 | 103 | 0.64 |
| 5 | 4.0 | 25 | 115 | — |
| 6 | 19.8 | 35.8 | 120 | 0.69 |
| 7 | 6.7 | 29.6 | 97 | 0.59 |
| A | 56.5 | 32.6 | 69 | 0.69 |
| B | 0.9 | 11 | 75 | 0.61 |

Figure 2:
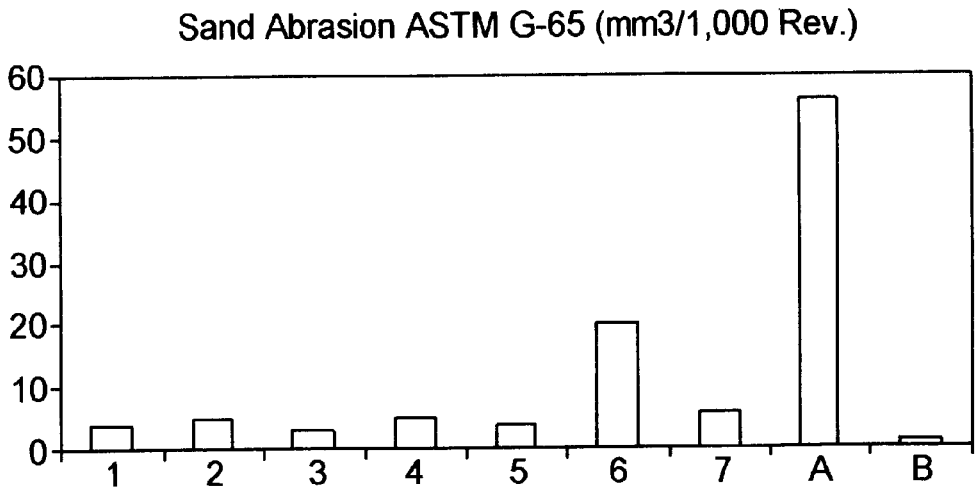
FIG. 2 is a bar graph of wear resistance data that compares coatings of the invention to comparative corrosion and wear resistant coatings.
Figure 3:
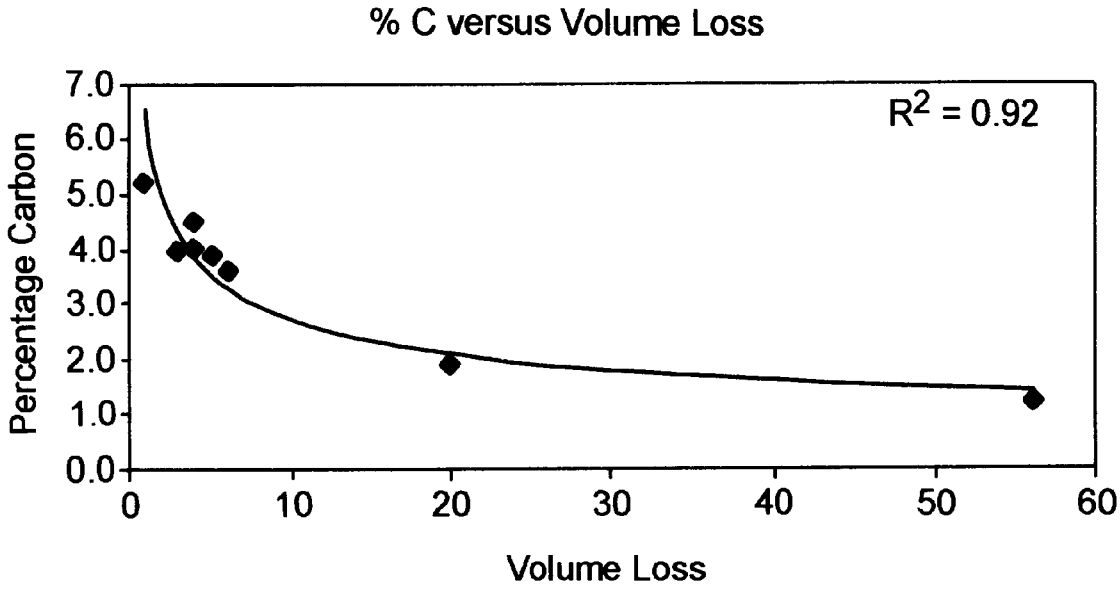
FIG. 3 is a plot of percent carbon versus volume loss for coatings of the invention.

The bar graph of FIG. 2 illustrates the excellent sand abrasion resistance achieved with the coating produced. FIG. 3 plots the relationship of percent carbon to the percent volume loss of the coatings of FIG. 2. This appears to illustrate a strong correlation between volume percent carbide phase and wear resistance.

Heating the powders in hydrochloric acid (HCl) and phosphoric acid ($H_3PO_4$) acids for 1 hour at 100° C. determined weight loss from accelerated attack. After measuring the weight loss, placing the powder in nitric acid ($HNO_3$) for another hour at 100° C. to test a second highly corrosive environment. Table 6 below provided the percent weight loss as measured after the first digestion, second digestion and total provides a total percentage weight loss.

TABLE 6

| Powder | Corrosion % 1st | Corrosion % 2nd | Total |
|---|---|---|---|
| 2 | 2.4 | 1.8 | 4.1 |
| 4 | 4.5 | 1.9 | 6.3 |
| 6 | 10.0 | 3.9 | 13.6 |
| 7 | 4.6 | 1.8 | 6.3 |
| A | 90.6 | 47.0 | 95.0 |
| B | 8.6 | <1.0 | 8.6 |

These powders had a better corrosion resistance than the Stellite 6 powder—a composition well know for its excellent corrosion resistance.

In summary, the invention provides a powder that forms coatings having a unique combination of properties. These coatings have a combination of wear and corrosion resistance not achieved with conventional powders. Furthermore, the coatings advantageously, suppress the formation of large chromium-containing carbides to further improve the wear resistance-the coating is less aggressive against the mating surface.

Other variations and modifications of this invention will be obvious to those skilled in the art. This invention is not limited except as set forth in the claims.

We claim:

1. A corrosion resistant powder useful for deposition through thermal spray devices, the powder consisting essentially of, by weight percent, about 30 to 60 tungsten, about 27 to 60 chromium, about 1.5 to 6 carbon, a total of about 10 to 40 cobalt plus nickel and incidental impurities plus melting point suppressants.

2. The corrosion resistant powder of claim 1 wherein the powder contains about 10 to 30 cobalt.

3. The corrosion resistant powder of claim 1 wherein the powder contains about 10 to 30 nickel.

4. The corrosion resistant powder of claim 1 wherein the powder has a morphology that lacks carbides having an average cross section width in excess of 10 $\mu$m.

5. A corrosion resistant powder useful for deposition through thermal spray devices, the powder consisting essentially of, by weight percent, about 30 to 55 tungsten, about 27 to 55 chromium, about 1.5 to 6 carbon, a total of about 10 to 35 cobalt plus nickel and incidental impurities and 0 to 5 melting point suppressants.

6. The corrosion resistant powder of claim 5 wherein the powder contains about 10 to 30 cobalt.

7. The corrosion resistant powder of claim 5 wherein the powder contains about 10 to 30 nickel.

8. The corrosion resistant powder of claim 5 wherein the powder has a morphology that lacks carbides having an average cross section width in excess of 5 $\mu$m.

9. A corrosion resistant powder useful for deposition through thermal spray devices, the powder consisting essentially of, by weight percent, about 30 to 50 tungsten, about 30 to 50 chromium, about 1.5 to 5 carbon, a total of about 10 to 30 cobalt plus nickel and incidental impurities and 0 to 3 melting point suppressants.

10. The corrosion resistant powder of claim 9 wherein the powder contains about 10 to 30 cobalt.

11. The corrosion resistant powder of claim 9 wherein the powder contains about 10 to 30 nickel.

12. The corrosion resistant powder of claim 9 wherein the powder has a morphology that lacks carbides having an average cross section width in excess of 2 $\mu$m.

13. The corrosion resistant powder of claim 9 wherein the powder contains about 35 to 45 tungsten, about 30 to 40 chromium, about 3 to 5 carbon, and the total cobalt plus nickel is about 15 to 25.

14. The corrosion resistant powder of claim 9 wherein the powder contains about 30 to 40 tungsten, about 40 to 50 chromium, about 1.5 to 5 carbon, and the total cobalt plus nickel is about 15 to 25.

15. The corrosion resistant powder of claim 9 wherein the powder contains about 30 to 40 tungsten, about 45 to 50 chromium, about 3 to 5 carbon, and the total cobalt plus nickel is about 10 to 15.

16. A corrosion resistant coating having good wear resistance, the coating consisting essentially of, by weight percent, about 30 to 60 tungsten, about 27 to 60 chromium, about 1.5 to 6 carbon, a total of about 10 to 40 cobalt plus nickel and incidental impurities and melting point suppressants.

17. The corrosion resistant coating of claim 16 wherein the coating contains about 30 to 50 tungsten, about 1.5 to 5 carbon and about 30 to 50 chromium.

18. The corrosion resistant coating of claim 16 wherein the coating contains about 35 to 45 tungsten, about 30 to 40 chromium, about 3 to 5 carbon and the total cobalt plus nickel is about 15 to 25.

19. The corrosion resistant coating of claim 16 wherein the coating contains about 30 to 40 tungsten, about 40 to 50 chromium, about 1.5 to 5 carbon and the total cobalt plus nickel is about 15 to 25.

20. The corrosion resistant coating of claim 16 wherein the coating contains about 30 to 40 tungsten, about 45 to 50 chromium, about 3 to 5 carbon and the total cobalt plus nickel is about 10 to 15.

* * * * *